US005819984A

United States Patent [19]

Krueger

[11] Patent Number: 5,819,984

[45] Date of Patent: Oct. 13, 1998

[54] PACKAGE WITH STORAGE AND PLUG RETENTION FEATURES

[75] Inventor: Kurtis W. Krueger, Waukesha, Wis.

[73] Assignee: AptarGroup, Inc., Crystal Lake, Ill.

[21] Appl. No.: 787,667

[22] Filed: Jan. 23, 1997

[51] Int. Cl.[6] ..... B65D 43/04

[52] U.S. Cl. ..... 222/181.2; 222/212; 222/494; 222/538; 222/563; 220/379; 220/751; 215/399

[58] Field of Search ..... 222/180, 181.1, 222/181.2, 181.3, 212, 494, 538, 563; 220/379, 751; 215/399

[56] References Cited

U.S. PATENT DOCUMENTS

| | | | |
|---|---|---|---|
| 3,078,017 | 2/1963 | Waskönig et al. . | |
| 3,212,679 | 10/1965 | Schmidt, Jr. . | |
| 3,441,178 | 4/1969 | Dgetluck . | |
| 4,728,006 | 3/1988 | Drobish et al. . | |
| 4,749,108 | 6/1988 | Dornsbusch et al. . | |
| 4,969,581 | 11/1990 | Seifert et al. | 222/212 |
| 5,033,655 | 7/1991 | Brown . | |
| 5,115,950 | 5/1992 | Rohr | 222/490 |
| 5,271,531 | 12/1993 | Rohr et al. | 222/212 |
| 5,409,144 | 4/1995 | Brown | 222/185 |

*Primary Examiner*—J. Casimer Jacyna
*Attorney, Agent, or Firm*—Rockey, Milnamow & Katz, Ltd.

[57] ABSTRACT

A package is provided with a container having a wall defining a dispensing aperture establishing communication between the interior and exterior of the container. A plug is provided for at least generally occluding the dispensing aperture. The plug includes a post, an exterior flange on the post, and an interior bead on the post spaced from the exterior flange to define a groove between the flange and bead. The plug can be inserted in the dispensing aperture and retained therein by engagement of the container wall by the plug flange and bead. A tab extends from the container and defines a storage aperture for receiving the plug for storage after removal of the plug from the dispensing aperture. The tab may also include an aperture for receiving a hook by which the package can be hung in an inverted orientation.

8 Claims, 1 Drawing Sheet

PACKAGE WITH STORAGE AND PLUG RETENTION FEATURES

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to packages from which a product can be dispensed through an aperture after removing a plug from the aperture. The invention is particularly suitable for use with a squeeze-type container.

BACKGROUND OF THE INVENTION AND TECHNICAL PROBLEMS POSED BY THE PRIOR ART

A variety of packages, including dispensing containers, have been developed for personal care products such as shampoos, lotions, etc., as well as for other materials. Such packages typically include a container with a dispensing aperture. The container may have a body with a unitary end wall defining the dispensing aperture. Alternatively, the container may have a closure mounted to the container body over the mouth of the container body, and the closure has an end wall defining the dispensing aperture.

One type of dispensing system for these kinds of packages typically includes a flexible, pressure-openable, self-sealing, slit-type dispensing valve which can be mounted either directly in the container body or in a separate closure over the container body mouth. When the container is squeezed, the valve slits open, and the fluid contents of the container are discharged through the open slits of the valve. The valve automatically closes to shut off fluid flow therethrough upon removal of the increased pressure.

Designs of closures using such valves are illustrated in the U.S. Pat. Nos. 5,271,531 and 5,033,655, and 5,531,363. The illustrated closures each typically include a body or base mounted on the container to hold the valve over the container mouth.

A lid, cap structure, or plug can be provided for covering the valve during shipping and when the container is otherwise not in use. See, for example, FIGS. 31–34 of U.S. Pat. No. 5,271,531. Such a lid or plug can be designed to prevent leakage from the valve under certain conditions. The plug can also keep the valve clean and/or protect the valve from damage. The plug structure can be hinged to the container body or closure.

In some applications, however, it may be desirable to provide a separate plug that is completely removable from the package dispensing aperture. In such a situation, it would be desirable to have a means for conveniently retaining the separate plug with the opened package. It would also be advantageous to provide a plug retention system that could be employed with other types of packages that have plugged dispensing orifices but that do not have dispensing valves.

Because a closure or container with a pressure-openable dispensing valve remains closed unless the container is squeezed, the container cap or plug can be removed, and the opened container can be stored on a counter or shelf in an inverted position (with the dispensing valve at the bottom). The fluid product does not leak through such a valve, and there is virtually no product residue on the exterior of the valve or surrounding container surfaces.

It would be desirable to provide means for hanging such a container in the inverted position. In such a hanging position, the product would flow under the influence of gravity to the dispensing valve. Thus, the product could be quickly squeezed out of the container without having to wait for a sufficient quantity of product to be squeezed toward the dispensing end of the container.

It would also be beneficial if a package could be provided with a plug retention system and hanging system that could accommodate the use of a variety of different materials. Further, it would be desirable if such an improved packaging systems could accommodate efficient, high quality, large volume manufacturing techniques with a reduced product reject rate.

The present invention provides an improved package which can accommodate designs having the above discussed benefits and features.

SUMMARY OF THE INVENTION

According to one aspect of the present invention, an improved package is provided for dispensing a fluid product. The package includes a container having a wall defining a dispensing aperture which establishes communication between the interior and exterior of the container. In the preferred embodiment, the wall containing the dispensing aperture may be incorporated in a separate closure which is mounted over the mouth of the container body.

A plug, stopper, cap, or the like is provided for generally occluding the dispensing aperture. In some applications, it is not necessary that the dispensing aperture be occluded in a leak-tight manner.

The plug includes a post, an exterior flange on the post, and an interior bead on the post. The bead is spaced from the exterior flange to define a grove between the flange and the bead.

The plug can be inserted in the dispensing aperture and retained therein by engagement of the bead with the interior side of the wall and by engagement of the flange with the exterior side of the wall.

The container includes an extending tab defining a storage aperture for receiving the plug for storage after removal of the plug from the dispensing aperture. The plug can be inserted in the storage aperture and retained therein by engagement of the bead with one side of the tab and by engagement of the flange with the other side of the tab.

In a preferred embodiment, the tab also defines a hanging aperture for receiving a hook by which the container may be hung in an inverted orientation.

Numerous other advantages and features of the present invention with become readily apparent from the following detailed description of the invention, from the claims, and from the accompanying drawings.

BRIEF DESCRIPTION OF THE DRAWINGS

In the accompanying drawings that form part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For the ease of description, the package components of this invention are described in various positions, and terms of such as upper, lower, horizontal, etc., are used with reference to these positions. It will be understood, however, that the components may be manufactured and stored in orientations other than the ones described.

Figure 1:
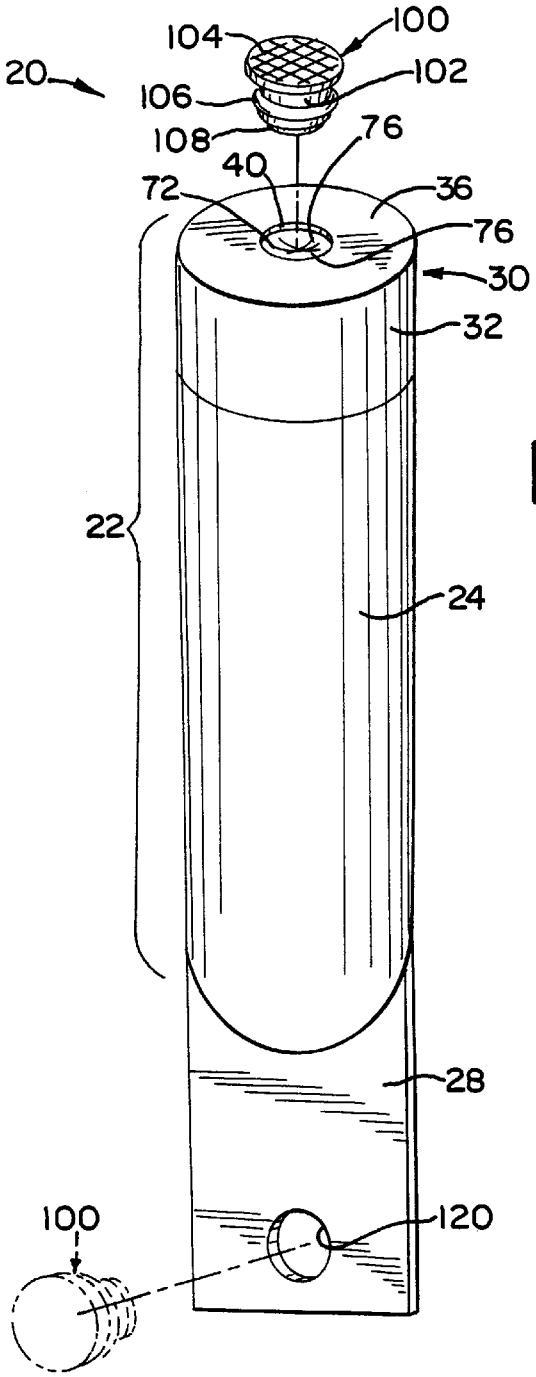
FIG. 1 is an exploded, perspective view of a first embodiment of a package of the present invention.
Figure 2:
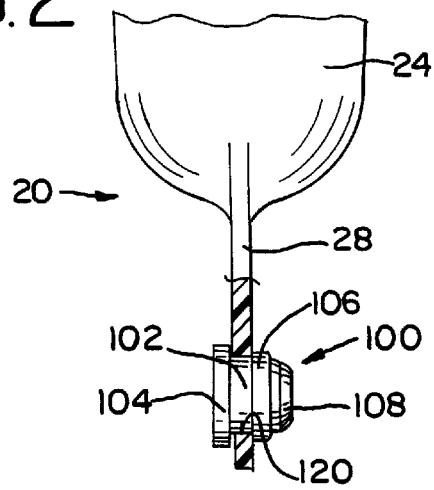
FIG. 2 is a fragmentary side view, partially in cross-section, showing the plug in the container tab storage aperture.

With reference to the figures, a first embodiment of a package of the present invention is illustrated in FIGS. 1–2 and is represented generally in those figures by reference numeral 20. The first embodiment of the package 20 includes a container 22.

The container 22 includes a container body 24 which has a generally tubular shape. The body 24 can be conveniently made from a tube of thermoplastic material which is heat sealable. The bottom end of the container body 24 can be closed by heat sealing the tube closed to define a flat tab 28 extending outwardly from the container body 24.

The upper end of the container body 24 may be provided with a conventional mouth (which could include a reduced diameter neck structure not visible in the figures). A separate closure 30 is mounted over the container mouth or neck. The closure 30 includes a skirt 32 extending around an upper portion of the container body 24. The upper portion of the container body 24 may have a suitable connecting means (e.g., a conventional thread or a conventional snap-fit bead (not illustrated)) for engaging a suitable closure skirt cooperating means (such as a thread or snap-fit bead (not shown)) to secure the container body 24 to the closure 30. The closure 30 and container body 24 could also be fixed together by an induction melt weld, ultrasonic melt weld, adhesive, or the like.

Alternatively, the closure 30 may be formed as a unitary part of the container body by appropriate molding techniques. The particular structure of the upper end of the container 22, whether formed as a unitary structure or formed from a separate body 24 and closure 30 as illustrated, is a matter of design choice. If a separate closure 30 is provided, the detailed structure of the means for attaching the closure 30 to the container body 24 forms no part of the present invention.

The upper end of the container 22, whether formed as part of a unitary body 24 or whether defined by a separate closure 30, includes an end wall 36 which defines a dispensing aperture 40. In the embodiment illustrated in FIGS. 1 and 2, the end wall 36 has a generally flat, annular configuration. However, the end wall 36 may have other regular or irregular shapes and may be convex or concave. The end wall 36 may be a relatively small, and the dispensing aperture 40 may be relatively large.

In a preferred form of the package 20 illustrated in FIGS. 1 and 2, the end wall 36 and dispensing aperture 40 are defined by a closure 30 which contains a conventional, pressure-openable, dispensing valve having a central membrane 72 which defines two, mutually perpendicular, intersecting slits 76. When the valve is in the normal, unactuated rest position illustrated in FIG. 1, the central membrane 72 is at a first location spaced inwardly of the dispensing aperture 40 and has a concave configuration in which the slits 76 are closed.

If the container body 24 is squeezed, the pressure within the container is increased. If the container pressure is increased sufficiently, the membrane 72 is deflected outwardly to a second location closer to the dispensing aperture 40, and the slits 76 open. More specifically, sector shaped flaps defined between the slits 76 open to permit the fluid product within the container body 24 to be dispensed.

The above-described pressure openable valve may be of any suitable type, such as the conventional pressure-openable valve described in detail in the U.S. Pat. No. 5,531,363 wherein such a valve is identified by the reference numeral 70 and is illustrated in that patent in FIGS. 5–8. A suitable structure for retaining such a valve in a closure is also illustrated in FIG. 5 of that patent. The description of the valve and retention structure set forth in the U.S. Pat. No. 5,531,363 is incorporated herein by reference thereto to the extent not inconsistent herewith. The detailed structure of such a valve and valve retention structure forms no part of the present invention.

Such pressure-openable dispensing valves function generally satisfactorily in applications for which they are designed. However, when a filled container having such a dispensing valve is put into distribution channels for shipping, warehousing, stocking, etc., accidental or intentional loads may be imposed on the container. Excessive impact forces on the container may cause the container to be squeezed so as to increase the internal pressure sufficiently to open the valve. Even if the container is provided with a film over-wrap or rigid overcap, impacts during shipping could cause some of the fluid product to be squirted through the valve beneath any overcap, and this can result in a messy residue on the exterior surface of the valve and perhaps on the surfaces defining the dispensing aperture of the container.

To prevent the pressure-openable valve from discharging product when the container is subjected to impacts or other squeezing forces during shipment or storage, a plug or restraint member 100 is provided for being disposed in the dispensing aperture 40. The plug 100 prevents the valve membrane 72 from deflecting outwardly a distance sufficient to open the valve dispensing slits 76.

The plug 100 includes a post 102 which is adapted to pass through the dispensing aperture 40. The plug 100 includes an exterior flange 104 on one end of the post and an interior bead 106 on the post 102 at a location spaced from the exterior flange 104. The diameter of plug exterior flange 104 is greater than the diameter of the dispensing aperture 40. The exterior diameter of the plug bead 106 is slightly larger than the dispensing aperture 40. The post 102 may extend beyond the bead 106 as illustrated in FIG. 2 to define a distal end 108.

In the preferred form of the first embodiment illustrated in FIGS. 1 and 2, the package end wall 36 is a somewhat flexible, thermoplastic material which accommodates a slight, temporary, elastic deformation when the plug 100 is inserted into the dispensing aperture 40. The plug bead 106 may also temporarily deform a small amount. In any event, there is sufficient elastic deformation of the end wall 36 and/or plug bead 106 to accommodate the insertion of the plug bead 106 past the end wall 36.

Because the diameter of the exterior flange 104 is larger than the diameter of the dispensing aperture 40, the flange 104 establishes a positive abutment engagement with the end wall 36 when the plug 100 is fully inserted into the dispensing aperture 40. The plug 100 is thus retained in a snap-fit engagement within the aperture 40 on the end wall 36.

When the plug 100 is snap-fitted into the end wall 36, the plug 100 at least generally occludes the dispensing aperture. It need not necessarily form a leak-tight seal. Preferably, when the plug 100 is seated within the dispensing aperture 40, the plug distal end 108 prevents the valve membrane 72 from moving outwardly a distance sufficient to open the slits 76 if the container body 24 is squeezed or otherwise subjected to impact forces that would increase the internal pressure. The plug distal end 108 may directly contact the exterior surface of the valve membrane 72 when the valve membrane 72 is in the concave, fully inward position (illustrated in FIG. 1).

However, the plug 100 may alternatively be provided with a shorter post 102 so that the distal end 108 of the seated plug 100 is spaced outwardly slightly from the membrane 72. With such a design, if the container is subjected to an over-pressure condition created either by squeezing or by an impact, then the valve membrane 72 can move outwardly a small distance until it engages the plug distal end 108. The small amount of movement of the valve membrane 72 is not sufficient to effect opening of the valve slits 76. However, such movement of the valve membrane 72 increases the interior volume of the system and thereby prevents the pressure from increasing as much as would otherwise occur if the valve membrane 72 did not deflect outwardly somewhat. Thus, the small outward deflection of the valve membrane 72 can minimize the effect of an over-pressure condition.

Because the valve membrane 72 cannot open when the plug 100 is properly seated within the dispensing aperture 40, the plug 100 need not form a leak-tight seal with the end wall 36. However, if the package 20 does not include an internal dispensing valve, then it may be desirable to provide a sufficiently tight snap-fit engagement between the plug 100 and end wall 36 to provide a leak-tight seal.

When it is desired to dispense the product from the container 20, the plug 100 is removed by prying it out of the dispensing aperture 40. If desired, the exterior portion of the plug flange 104 may be provided with a suitable tab, ring, or hook (not shown) for assisting the user in removing the plug 100.

In some situations, it may be desirable to retain the plug 100 for future use in again occluding the dispensing aperture 40. Although the package 20 can be inverted with the plug 100 removed, the fluid product will not normally leak through the valve. However, it may be desirable to prevent leakage during over-pressure conditions if the package 20 is subsequently transported to another location or packed in a suitcase where the package 20 could be subjected to accidental impact forces. Further, if the package 20 does not include an internal dispensing valve, then it may be necessary to reinstall the plug 100 to prevent leakage or evaporation of the product from the container.

The package 20 includes a plug retention system in the tab 28 at the bottom of the container body 24. The tab 28 defines a storage aperture 120 for receiving the plug 100. The storage aperture 120 preferably has substantially the same diameter as the dispensing aperture 40. Preferably, the thickness of the tab 28 is identical to, or substantially the same as, the thickness of the container end wall 36. The plug 100 can then be inserted in a snap-fit engagement in the storage aperture 120 as illustrated in FIG. 2. The thickness of the tab 28 may be slightly greater than, or slightly less than, the thickness of the container end wall 36. It is sufficient that the plug 100 be retained in the storage aperture 120 with sufficient engagement to prevent the plug 100 from falling out during normal handling of the container and to prevent the plug 100 from being knocked out when the container is laid on a counter.

Figure 4:
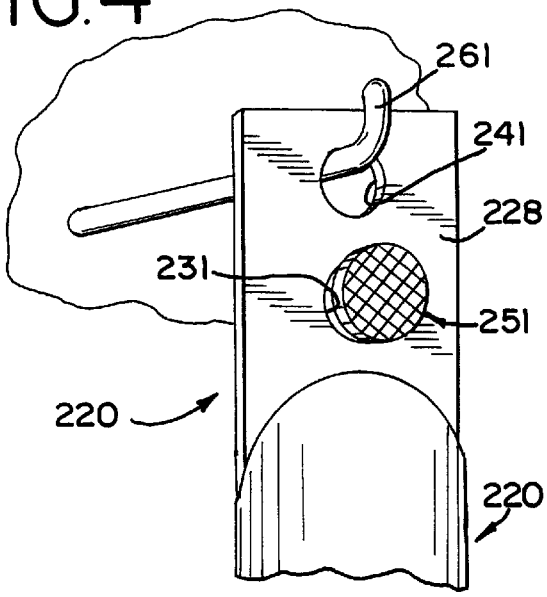
FIG. 4 is a view similar to FIG. 3, but FIG. 4 shows the packaging hanging from a hook and shows the plug retained in the storage aperture.
Figure 3:
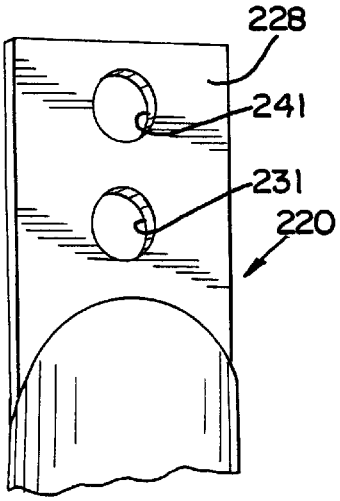
FIG. 3 is a fragmentary, perspective view of a second embodiment of the package in an inverted orientation.

A second embodiment of the package of the present invention is illustrated in FIGS. 3 and 4 wherein the package is designated generally by the reference numeral 220. The package 220 has a structure substantially identical to that described above for the structure of the container 20 illustrated in FIGS. 1 and 2. However, the package 220 includes an extending tab 228 which defines two holes, a plug storage aperture 231 and a hanging aperture 241.

As illustrated in FIG. 4, the package 220 includes a plug 251 which may be identical to the plug 100 described above with reference to the first embodiment illustrated in FIGS. 1 and 2, and the plug 251 may be stored in a snap-fit engagement in the storage aperture 231.

The hanging aperture 241 is adapted to receive a hook 261 or other member by which the package 220 may be hung. The package 220 may be conveniently hung in an inverted orientation with the plug 251 removed from the dispensing end of the package and stored in the aperture 231.

Of course, to prevent the fluid product from leaking out of the package 220 when the plug 251 is stored in the storage aperture 231, the package 220 must include a suitable dispensing control device, such as the pressure-openable dispensing valve described above for the first embodiment illustrated in FIGS. 1 and 2.

The storage aperture (e.g., the storage aperture 120 shown in FIGS. 1 and 2 or the storage aperture 231 shown in FIGS. 3 and 4) may be readily created by punching material from the tab or by otherwise cutting away the material from the tab. The hanging aperture 241 (FIGS. 3 and 4) may be similarly formed. Other suitable processes for forming the apertures may be employed.

It will be readily observed from the foregoing detailed description of the invention and from the illustrations thereof that numerous other variations and modifications may be effected without departing from the true spirit and scope of the concepts or principles of this invention.

What is claimed is:

1. A package comprising:

a container having a wall defining a dispensing aperture establishing communication between the interior and exterior of said container;

a plug for at least generally occluding said dispensing aperture, said plug including a post, an exterior flange on said post, and an interior bead on said post spaced from said exterior flange to define a groove between said flange and bead so that said plug can be inserted in said dispensing aperture and retained therein by engagement of said bead with the interior side of said wall and by engagement of said flange with the exterior of side of said wall; and a tab extending from said container and defining a storage aperture for receiving said plug for storage after removal of said plug from said dispensing aperture whereby said plug can be inserted in said storage aperture and retained therein by engagement of said bead with one side of said tab and by engagement of said flange with the other side of said tab.

2. The package in accordance with claim 1 in which said tab defines a hanging aperture for receiving a hook by which said container may be hung.

3. The package in accordance with claim 1 in which:

said container includes a valve disposed inwardly of said dispensing aperture;

said valve has a flexible membrane defining at least one normally closed slit when said membrane is at first location spaced inwardly of said dispensing aperture, said slit opening when said membrane is deflected outwardly by increased container pressure to a second location closer to said dispensing aperture;

said plug post has a distal end; and said plug post length is such that when said plug is inserted in said dispensing aperture, said distal end is engageable with said valve membrane sufficiently inwardly of said second location of said membrane so as to prevent said membrane slit from opening.

4. The package in accordance with claim 1 in which said plug is receivable in said dispensing aperture in a snap-fit engagement and is receivable in said storage aperture in a snap-fit engagement.

5. The package in accordance with claim 1 in which:

said container is elongated and includes a closed end opposite said dispensing aperture;

said tab is generally flat and extends from said container closed end;

said container includes a body formed from a tube of heat sealable material; and said closed end is formed by heat sealing said tube closed to define said flat tab extending from said container body.

6. The package in accordance with claim 1 in which said storage aperture is formed by punching material from said tab.

7. The package in accordance with claim 1 in which said storage aperture is formed by cutting away material from said tab.

8. The package in accordance with claim 1 in which said container has a body with an open end and a closure mounted to said body over said open end, said closure including said wall in which said dispensing aperture is defined.

* * * * *